United States Patent [19]

Venås

[11] Patent Number: 4,568,385

[45] Date of Patent: Feb. 4, 1986

[54] METHOD OF AND APPARATUS FOR ADDING HEAT TO MOLTEN METAL, AND ALSO APPLICATION OF THE METHOD

[75] Inventor: Karl Venås, Saupstad, Norway

[73] Assignee: Årdal og Sunndal Verk A.S., Oslo, Norway

[21] Appl. No.: 694,117

[22] Filed: Jan. 23, 1985

[30] Foreign Application Priority Data

Jan. 25, 1984 [NO] Norway ..... 840273

[51] Int. Cl.[4] ..... C22B 4/00

[52] U.S. Cl. ..... 75/10 R; 75/10 V; 75/12

[58] Field of Search ..... 75/10 R, 10 V, 12

[56] References Cited

U.S. PATENT DOCUMENTS 3,246,373 4/1966 Lyman ..... 75/12
3,792,848 2/1974 Ostberg ..... 266/34
4,177,060 12/1979 Tylko ..... 75/10 R
4,195,823 4/1980 Narita et al. ..... 75/53

*Primary Examiner*—Peter D. Rosenberg
*Attorney, Agent, or Firm*—Wenderoth, Lind & Ponack

[57] ABSTRACT

A hollow rotating body of a refractory material, with holes in the bottom and the side wall thereof is caused to rotate while immersed in molten metal. The metal inside the rotor is thus caused to rotate, and as a result, the metal flows into the rotor from the hole in the bottom and out through the holes in the side. The rotating metal in the rotor develops an upper surface with the shape of a paraboloid of revolution.

A shaft of the rotor is hollow and has extending therethrough a fixed electrode. With the molten metal as the other electrode, an electric arc is struck between the fixed electrode and the paraboloid surface of the metal inside the rotor, whereby heat is imparted to the metal.

5 Claims, 1 Drawing Figure

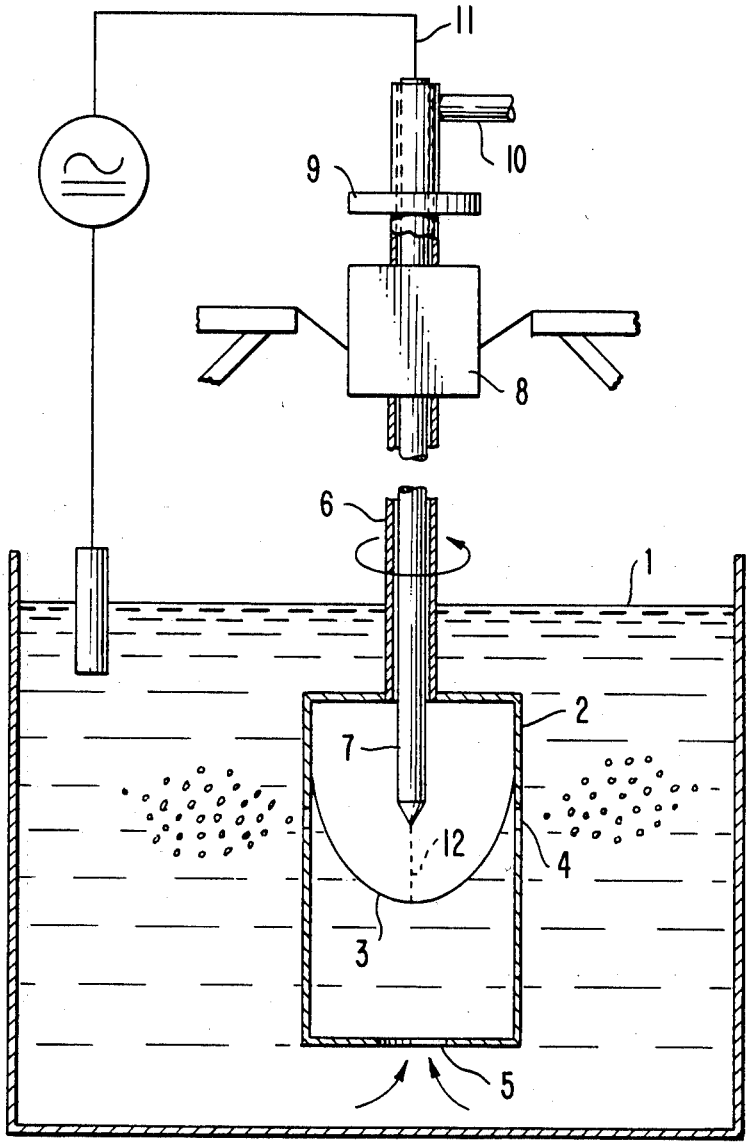
11
10
9
8
6
1
2
7
12
4
3
5

METHOD OF AND APPARATUS FOR ADDING HEAT TO MOLTEN METAL, AND ALSO APPLICATION OF THE METHOD

BACKGROUND OF THE INVENTION

This invention relates to a method of and apparatus for adding heat to molten metal.

In all forms of molten metal treatment at elevated temperatures, it is important to control the heat flow.

The first item here is to control the heat losses, expedient thermal insulation being of prime importance. This is however by no means always sufficient, and it is then necessary to add heat, preferably without at the same time adding to the melt unwanted substances.

Heat can be added through the bottom and walls of the container holding the melt, over the melt or in the melt. For practical and economic reasons, the latter method is often preferred, and is that on which the present invention is based.

It is known that an electric arc can be used, either between fixed electrodes or between a fixed electrode and the melt in order to add heat to the melt. This method results in large temperature differences between the upper and lower layers of the melt. Further, there can easily arise differences in the chemical composition of the upper and lower layers. In the upper layer, particularly near the electrode, components in the melt will evaporate whilst at the same time materials are added by the electrode, the usual occurrence being that carbon is given off by the electrode and absorbed by the melt.

Heating the melt by an electric arc thus results in gradients in temperature and in chemical composition. Achieving the desired metallurgical product requires experience, time and the analysis of samples throughout the process.

These problems would be reduced, or completely eliminated, if there were a simple method of continuously mixing the melt whilst it is being supplied with heat by an electric arc.

SUMMARY OF THE INVENTION

The present invention relates to a method of supplying heat by an electric arc to a melt, wherein the metal, with the help of a rotating hollow body, i.e. a rotor, immersed in the melt, is caused to rotate, and an electric arc is generated between the rotating metal and a fixed, adjustable electrode.

The rotor is a hollow body of revolution, supplied with one or more holes in the bottom and in the side wall, thereof and driven by a hollow shaft suspended over the melt, and the electrode, which may be adjusted with respect to height, is mounted in this hollow shaft.

Conventional carbon/graphite electrodes can be used, provided it is not necessary to protect the melt from material from the electrode.

Electric arcs between electrodes and the surface of the metal are known but they usually play in or against an essentially horizontal metal surface. According to the invention, the movement of the rotor will cause the metal inside the rotor to develop an upper surface with the shape of a paraboloid of revolution, and the centripetal forces will drive the metal out through the holes in the side of the rotor. This will bring about an efficient mixing of the molten metal, i.e. an evening-out of the chemical and temperature differences by circulation of the melt through the rotor.

The method and the rotor are extremely suitable for heating, refining or alloying metal melts, either batchwise or continuously. In metal flowing continuously, alloying can be performed either by the direct addition of alloying elements in solid or liquid state through the hollow shaft, or by adding materials from the electrode, for example carbon.

If the requirement is merely to add heat, it can be advantageous to make use of an electric arc produced by a plasma burner in which the anode consists of the molten metal caused to rotate inside a rotating hollow body, i.e. a rotor. The rotor has holes in the side wall and in the bottom thereof, and the cathode is adjustable, fixed body.

The cathode can consist of a metal with a high melting point which will not introduce any contaminants into the metal melt. The cathode can be placed in the hollow shaft of the rotor. A general difficulty in using a plasma burner as a heat source is that the anode is consumed and must be continuously renewed. This invention completely eliminates this problem, in that the rotating metal melt continuously renews its surface and retains its position.

Depending upon the object of the melting, the arc can operate in a vacuum or in a controlled atmosphere. In this manner, the method and apparatus are also suitable for refining molten metal. Hydrogen can, for example, be removed from molten aluminum by adding gases to the melt through the hollow shaft of the rotor. The gases may be passive inert gases such as nitrogen and argon which are used for flushing, or the gas may be active, such as chlorine or a chlorine compound such as Freon 12.

The rotor must be made of material which can withstand the temperature, the centripetal forces and attack by the melt. Furthermore, the material must be suitable for an expedient manufacturing process, perhaps with particular reference to powder metallurgy. Suitable materials include aluminum titanate, boron nitride, alumina and graphite.

For the actual choice, the method in which the melt wets the rotor is important. The wetting properties are significant for the size of the holes in the side and the bottom of the rotor. The diameter of the holes in the side should be from 1 mm up to 50% of the rotor diameter. The hole in the bottom, which may be non-circular, can have axes of 5—100% of the rotor diameter. The distance from the bottom to the side holes can be up to 20 mm or more, depending upon the overall size of the apparatus. The side of the rotor may be smooth, or equipped with blades of various shapes, both inside and outside, to bring the metal more rapidly into rotation. A non-circular hole in the bottom of the rotor is a very simple means of achieving the same effect. The rotor can also have shapes other than cylindrical. The inside can, for example, have the shape of a paraboloid of revolution.

BRIEF DESCRIPTION OF THE DRAWING

Other object, features and advantages of the present invention will be apparent from the following detailed description, taken with the accompanying drawing, wherein:

The single FIGURE is a schematic view of an apparatus according to the present invention.

DETAILED DESCRIPTION OF THE INVENTION

According to the invention, a molten metal has an upper surface 1. A rotor 2 in the form of a hollow body is immersed below the surface 1 of the molten metal. The rotor has an integral hollow shaft 6 extending upwardly above surface 1 and is supported by a shaft suspension arrangement 8 to be rotated by a drive arrangement 9. Hollow body 2 has in a bottom wall thereof an opening 5 and further has in a side wall thereof plural openings 4. Upon rotation of shaft 6 and body 2, a portion of the melt within body 2 will be rotated. This causes the melt to circulate upwardly through the bottom hole 5 into the body 2 and outwardly from body 2 through side openings 4 and also causes the melt portion within body 2 to develop an upper surface 3 configured in the shape of a paraboloid of revolution.

Extending through shaft 6 is a fixed electrode 7, the lower end of which extends into body 2 to a position to be spaced from upper surface 3 of the rotating melt portion within body 2. Electrical energy is applied between fixed electrode 7 and the melt, for example by means of conventional means 11 illustrated schematically. As a result, there is generated an arc 12 between fixed electrode 7 and the upper surface 3 of the melt portion. Accordingly, as the melt circulates through body 2 in the manner discussed above, such melt is heated by the arc 12.

As indicated above, gases may be added, for example for the purpose of shielding or refining the molten metal, and such gases may be added to hollow shaft 6 by means such as connection 10.

I claim:

1. A method of adding heat to a metal melt, said method comprising:

immersing within said melt a hollow body having therein a plurality of openings and a hollow shaft extending from said hollow body upwardly from said melt;

rotating said shaft and body, and thereby causing rotation of a portion of said melt within said body, whereby said melt circulates through said holes in said body and said melt portion within said body develops an upper surface with the shape of a paraboloid of revolution;

fixedly positioning an electrode to extend through said shaft into said body to a position spaced from said upper surface of said melt portion; and applying electrical energy between said fixed electrode and said melt, and thereby generating an arc between said fixed electrode and said upper surface of said melt portion, whereby said melt circulating through said body is heated by said arc.

2. A method as claimed in claim 1, comprising providing one said opening in a bottom wall of said body and plural said openings in a side wall of said body, and thereby circulating said melt upwardly into said body through said one opening and outwardly from said body through said plural openings.

3. An apparatus for adding heat to a metal melt, said apparatus comprising:

a hollow body to be immersed in a metal melt, said body having therein a plurality of openings and a hollow shaft extending from said hollow body upwardly of the melt;

means for rotating said shaft and body, and thereby for causing rotation of a portion of the melt within said body, for causing the melt to circulate through said holes in said body, and for causing the melt portion within said body to develop an upper surface with the shape of a paraboloid of revolution;

a fixed electrode extending through said shaft into said body to a position spaced from the upper surface of the melt portion therein; and means for applying electrical energy between said fixed electrode and the melt and thereby for generating an arc between said fixed electrode and the upper surface of the melt portion, whereby the melt circulating through said body is heated in said arc.

4. An apparatus as claimed in claim 3, wherein said body includes a bottom wall having therein one said opening and a side wall having therein plural said openings, whereby the melt circulates upwardly into said body through said one opening and outwardly from said body through said plural openings.

5. An apparatus as claimed in claim 4, wherein said one opening is non-circular.

* * * * *